US010030529B2

(12) United States Patent
Bergman et al.

(10) Patent No.: US 10,030,529 B2
(45) **Date of Patent: *Jul. 24, 2018**

(54) COMBINED FEATHERSEAL SLOT AND LIGHTENING POCKET

(71) Applicant: United Technologies Corporation, Farmington, CT (US)

(72) Inventors: Russell J. Bergman, Windsor, CT (US); Scott A. Kovach, Higganum, CT (US)

(73) Assignee: United Technologies Corporation, Farmington, CT (US)

( * ) Notice: Subject to any disclaimer, the term of this patent is extended or adjusted under 35 U.S.C. 154(b) by 189 days.

This patent is subject to a terminal disclaimer.

(21) Appl. No.: 15/238,207

(22) Filed: Aug. 16, 2016

(65) Prior Publication Data

US 2017/0167284 A1 Jun. 15, 2017

Related U.S. Application Data

(63) Continuation of application No. 12/711,327, filed on Feb. 24, 2010, now Pat. No. 9,441,497.

(51) Int. Cl.

| | |
|---|---|
| ***F01D 9/04*** | (2006.01) |
| ***F01D 11/00*** | (2006.01) |
| ***F01D 25/12*** | (2006.01) |

(52) U.S. Cl.

CPC ..... *F01D 11/005* (2013.01); *F01D 9/041* (2013.01); *F01D 25/12* (2013.01); *F05D 2220/323* (2013.01); *F05D 2230/12* (2013.01); *F05D 2230/21* (2013.01); *F05D 2240/12* (2013.01); *F05D 2240/55* (2013.01); *F05D 2250/75* (2013.01); *F05D 2260/20* (2013.01)

(58) Field of Classification Search

CPC ... F01D 9/04; F01D 9/041; F01D 5/02; F01D 5/22; F01D 11/005; F01D 11/00; F01D 25/12; F05D 2230/21; F05D 2230/12; F05D 2220/323; F05D 2240/55; F05D 2240/75; F05D 2240/12; F05D 2260/20

See application file for complete search history.

(56) References Cited

U.S. PATENT DOCUMENTS

| | | | |
|---|---|---|---|
| 5,531,457 | A | 7/1996 | Tibbott et al. |
| 5,738,490 | A | 4/1998 | Pizzi |
| 5,762,472 | A | 6/1998 | Pizzi et al. |
| 5,818,005 | A | 10/1998 | Pratt et al. |
| 5,988,975 | A | 11/1999 | Pizzi |
| 6,241,467 | B1 | 6/2001 | Zelesky et al. |
| 6,254,333 | B1 | 7/2001 | Merry |
| 6,918,743 | B2 | 7/2005 | Gekht et al. |

(Continued)

FOREIGN PATENT DOCUMENTS

| | | |
|---|---|---|
| EP | 1 956 196 | 8/2008 |
| GB | 1223302 | 2/1971 |

OTHER PUBLICATIONS

Extended European Search Report for EU Application No. 11250213.3 dated Jul. 15, 2014.

*Primary Examiner* — Logan Kraft
*Assistant Examiner* — Joshua R Beebe
(74) *Attorney, Agent, or Firm* — Carlson, Gaskey & Olds, P.C.

(57) ABSTRACT

A segmented engine component has multiple segments which are connected to each other via a featherseal arrangement. Each of the components has a combined featherseal slot and lightening pocket.

20 Claims, 3 Drawing Sheets

(56) References Cited

U.S. PATENT DOCUMENTS

| | | | |
|---|---|---|---|
| 7,128,522 | B2 | 10/2006 | Jutras |
| 7,217,089 | B2 | 5/2007 | Durocher et al. |
| 7,261,514 | B2 | 8/2007 | London et al. |
| 7,374,395 | B2 | 5/2008 | Durocher et al. |
| 7,967,555 | B2 | 6/2011 | Gagnon, Jr. et al. |
| 8,240,981 | B2 | 8/2012 | Spangler et al. |
| 2004/0240986 | A1 | 12/2004 | Burdgick |

COMBINED FEATHERSEAL SLOT AND LIGHTENING POCKET

CROSS-REFERENCE TO RELATED APPLICATION

This application is a continuation of U.S. patent application Ser. No. 12/711,327 filed on Feb. 24, 2010.

BACKGROUND OF THE INVENTION

The present application relates generally to featherseals and more specifically to a system and method for preparing a featherseal slot with a lightening pocket on a workpiece.

Gas turbine engines are utilized at high temperatures in order to maximize their efficiency. In order to operate at such temperatures, cooling is provided to select components, such as turbine vanes, thereby preventing overheating. In order for a coolant to reach the select components cooling paths, which have a curved shape, are used. Due to the cooling path shape, the turbine vanes are typically constructed out of segmented components to allow for maintaining the integrity of the cooling path despite differential expansion.

Coolant escapes between the segments of the segmented cooling path. Thus, a seal is placed between each of the segmented components and its adjacent components to create a single sealed pathway. The seal is a sheet of material, such as a metal, which is placed partially within a slot in one of the segments, and partially within a slot in the adjacent segment, thereby sealing the joint between the slots. Such a sealing arrangement is referred to as a featherseal.

When the engine is operating, pressure from the coolant holds the seal in place against the slot's wall on the low pressure side. Additionally, when the engine is not operational only a partial wall for the feather seal slot on the high pressure side is necessary to hold the featherseal in place. Since a full featherseal slot is not required at any time, a portion of the segment on the high pressure side can be removed creating a pocket with less material, thereby lightening the component. In order to create the lightening pocket, current state of the art techniques involve casting the part with the pocket removed.

SUMMARY OF THE INVENTION

Disclosed is a segmented gas turbine engine component. Each segment has multiple components. Each component has a body with coolant passages, at least one joint end with a combined featherseal slot and lightening passage. Each of the segments is connected to at least one adjacent segment such that a sealed cooling passage connects each of the segments cooling inlets.

Also disclosed is a method for creating a segmented engine component. The method casts each segment, and then simultaneously manufactures a featherseal slot and a lightening pocket into a circumferential edge of each of the segments. Each of the segments has a body with internal coolant passages. The body has at least a portion with a foil shaped profile, and at least one joint end. The joint end has coolant inlets connected to the internal coolant passages.

These and other features of the present invention can be best understood from the following specification and drawings, the following of which is a brief description.

DETAILED DESCRIPTION OF THE PREFERRED EMBODIMENT

Figure 1:
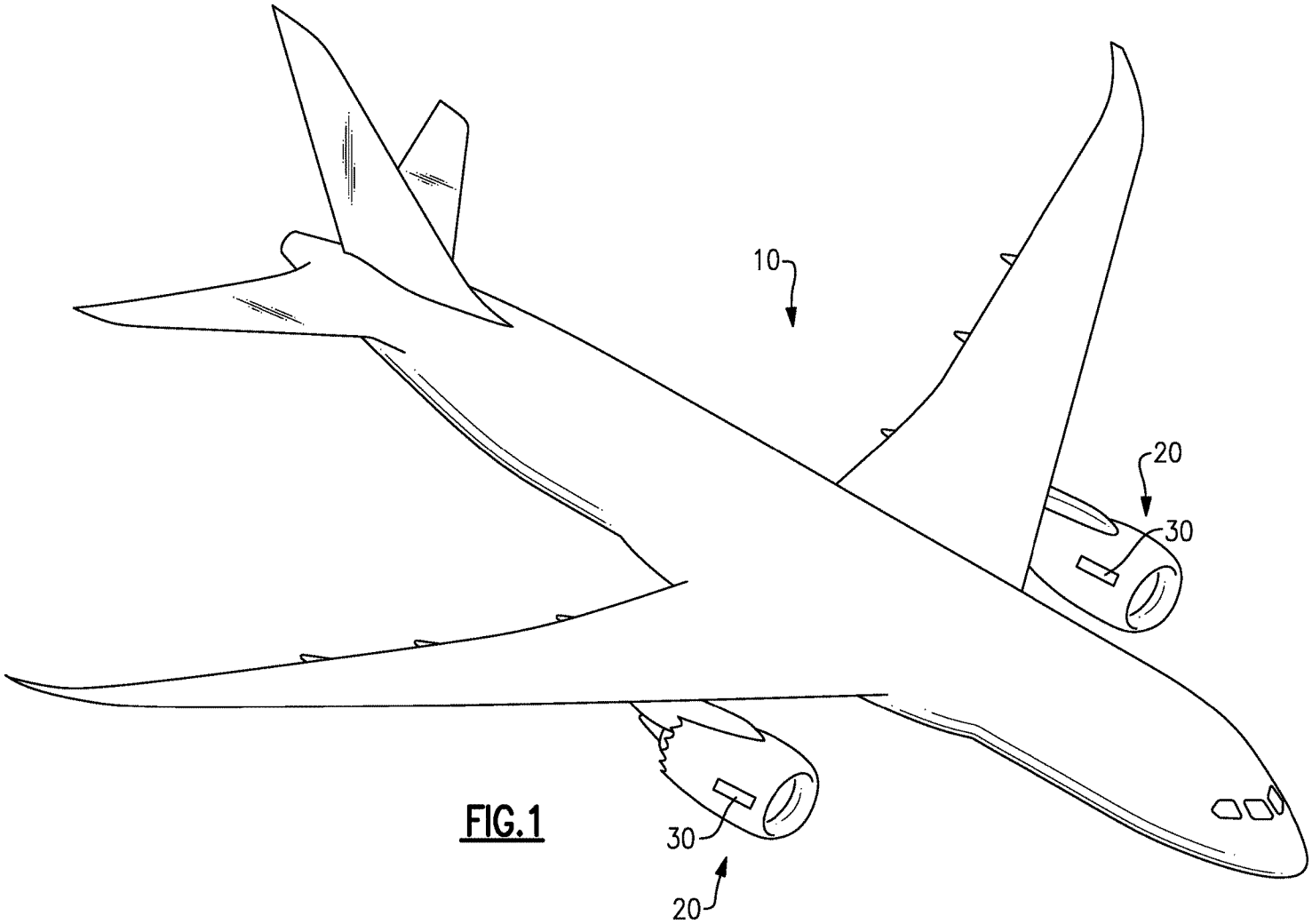
FIG. 1 schematically illustrates an example aircraft with a gas turbine engine in which select components are cooled.

Illustrated in FIG. 1 is an aircraft 10, which uses multiple gas turbine engines 20 to provide thrust. Maximum efficiency operations of the gas turbine engines 20 occur when the gas turbine engine 20 is operating at high temperatures. In order to facilitate operating at these temperatures, a cooling fluid flow path is provided to certain gas turbine engine components, such as engine vanes illustrated in schematically in FIG. 1 at 30 and FIGS. 2A and 2B. The gas turbine engine vane 30 structure is typically built with multiple segmented components in order to allow for differential expansion resulting from heating and cooling. When segmented components are used for the turbine engine vanes 30, a seal is placed between each segment and the adjacent segments in order to minimize the amount of cooling fluid escaping through the segment joints.

Figure 2A:
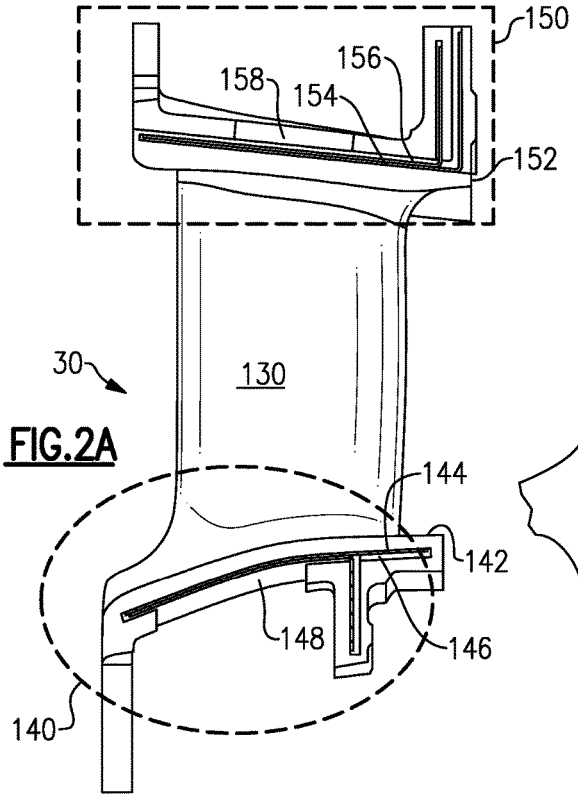
FIG. 2A illustrates a gas turbine engine vane segment.

FIG. 2A illustrates a side view of an example segment of a gas turbine engine vane 30, such as could be used in the example of FIG. 1. The vane segment 30 has a center foil 130 which includes internal cooling passages to allow cooling fluid flow to enter the foil 130 from either the first end 140 or the second end 150. Each of the ends includes a joint portion 142, 152. Each joint portion 142, 152 includes a featherseal 144, 154, a featherseal slot 146, 156, and a lightening pocket 148, 158.

Figure 2C:
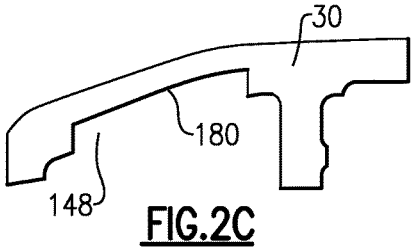
FIG. 2C illustrates a cast end segment where the lightning pocket was cast into the end segment.
Figure 2B:
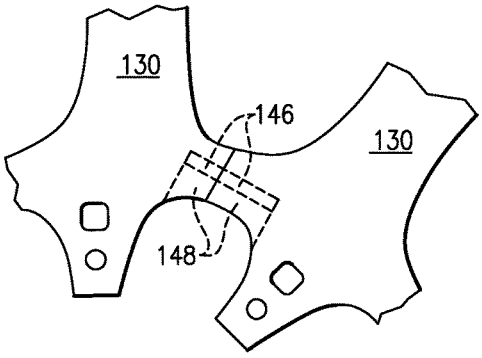
FIG. 2B illustrates a pair of gas turbine engine vane segments connected via a featherseal arrangement.

FIG. 2B illustrates a front partial view of two of the segments 30, illustrated in FIG. 2A, joined together via a featherseal arrangement. In the example of FIG. 2B, each of the components has a featherseal slot 146 and a lightening pocket 148. The featherseal slot 146 and lightening pockets 148 of each are aligned. A featherseal is inserted into the featherseal slot 146, with a portion of the seal being present in each segment's featherseal slot 146. A similar arrangement can be made connecting additional segments to each of the illustrated segments 30. While a featherseal slot 146 connecting only the first end 140 is used for illustrative purposes in FIG. 2B, the feather seal arrangement can connect both ends 150, 140 of each segment 30 to the corresponding ends of the adjacent segment 30.

Figure 3:
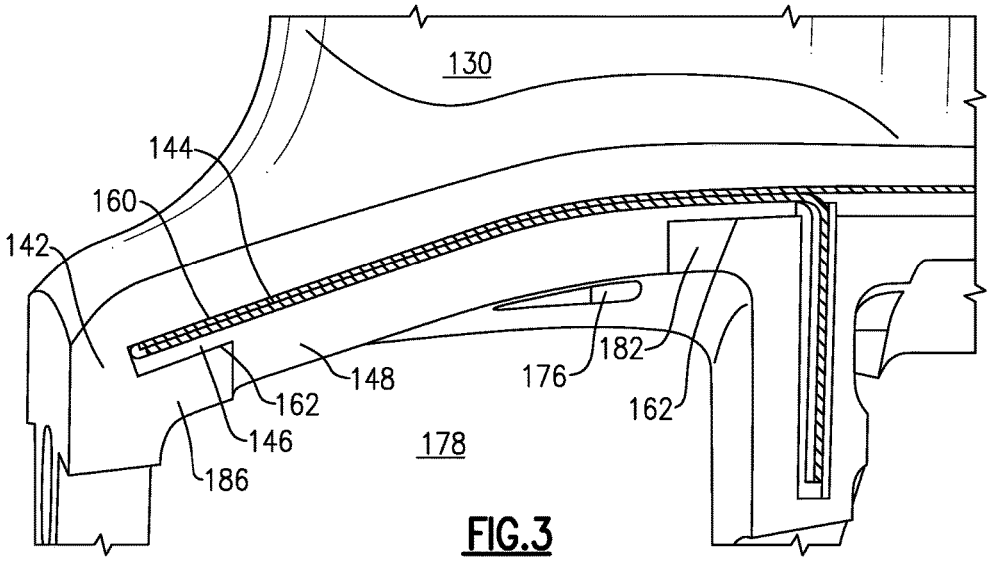
FIG. 3 illustrates an isometric view of an end of an example segment.

FIG. 3 isometrically illustrates the first end 140 of FIG. 2 in greater detail. The featherseal slot 146 has a top wall 160 which is unbroken across the featherseal slot 146 and is on the low pressure side. The featherseal slot additionally has a bottom wall 162 on the high pressure side, which is broken by the lightening pocket 148. Inserted into the featherseal slot 146 is a featherseal 144. The illustrated featherseal 144 is a double sheet of the sealing material; however, any number of sheets could be used subject to requirements for sealing efficiency, weight, and size. Additionally visible is a cooling inlet 176 which allows coolant to flow from a cooling passage 178 into the turbine vane 130, thereby allowing for cooling of the vane 130.

The joint portion 142 also includes two partial featherseal rails 186, 182. The partial featherseal rails 186, 182 are located on the low pressure side of the cooling flowpath, and function to hold the featherseal 144 in place while the engine is not running, and no coolant pressure is exerted. When the engine is operating coolant travels through the cooling passage 178 and into the cooling inlet 176 of each of the segmented vanes. This cooling flow creates a low pressure side (the featherseal slot wall 160) and a high pressure side (the featherseal slot wall 162) due to the force of the coolant pushing against the featherseal. When the coolant is flowing, no featherseal rails 186, 182 are required to hold the seal in place, since the pressure of the coolant will force the seal against the low pressure wall 160, and thereby secure the seal 144 in place.

When the engine is switched off, the coolant stops flowing, and the pressure is relieved. Since the pressure is no longer holding the seal 144 in position, the partial featherseal rails 186, 182 prevent the seal from falling out of position.

The illustrated cutout for the featherseal slot 146 and the lightening pocket 148 of FIGS. 2 and 3 is generally "T" shaped with a top, generally horizontal, portion forming the featherseal slot 146 and a wider vertical portion extending away from the featherseal slot 146 forming the lightening pocket 148. Although the illustrated figure includes a convex arched component and a horizontal component for the featherseal slot 146, the featherseal slot 146 can be straight, concave, or convex depending on the required shape for the specific application.

Creation of the featherseal slot 146 and the lightning pocket 148 of FIGS. 2 and 3 traditionally requires two separate manufacturing steps. The entire vane segment 30 is cast as a single material block with the lightening pocket 148 and a cast surface 180 included. A typical end cast in this manner is illustrated in FIG. 2C. The featherseal slot 146 is subsequently manufactured by grinding or EDM. When the tolerance of the cast surface 180 relative to featherseal slot 146 is larger than the width of the featherseal slot 146, the cast surface 180 can remain. One possible result of this technique is that the sealing surface (i.e. the contact between the seal 144 and the low pressure side wall 160) can be interrupted which results in an increased volume of coolant lost between the segments due to inadequate sealing. Another possible result of the casting tolerances is that flashing can be created. Flashings are sharp protrusions of material that can be a byproduct of the casting process.

Figure 4:
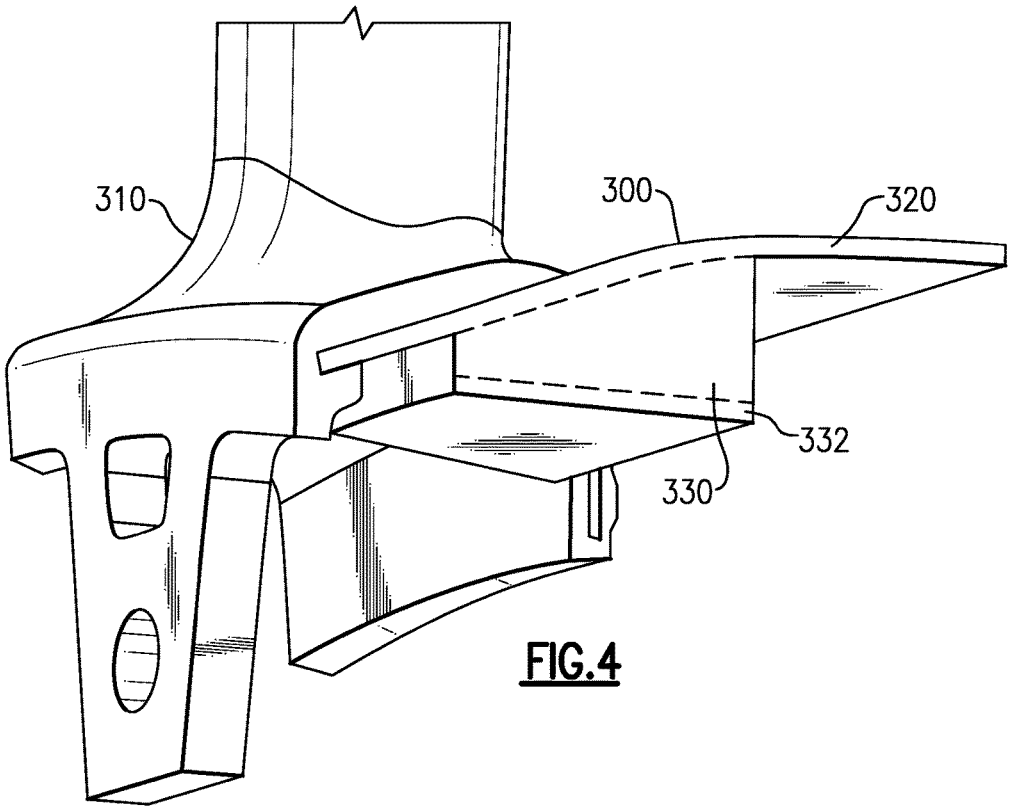
FIG. 4 illustrates an isometric view of an Electrical Discharge Machining (EDM) tool machining a featherseal slot and a lightening pocket into a segmented component.

One process which can be used to create the vane segment 30 with the featherseal slot 146 and the lightening pocket 148 is to cast the piece without the slot 146 or pocket 148 and mill the featherseal slot 146 and the lightening pocket 148 out of the piece after it has been cast. A system for performing this process is illustrated in FIG. 4. In order to prevent an interrupted sealing surface or undesirable burring, the pocket 148 and the featherseal slot 146 are milled at the same time using an electrical discharge. This process is referred to as Electrical Discharge Machining (EDM) and allows unique shapes to be milled out of materials that conventional milling techniques are unable to create. EDM operates by having a milling tool of a desired shape and running an electric current through the tool. In the EDM process, both the workpiece 310 and the tool 300 are submersed in a dielectric fluid.

The milling of the workpiece 310 (the vane segment 30) occurs by a series of rapidly recurring current discharges between the EDM tool 300 and the workpiece 310. When the distance between the EDM tool 300 and the workpiece 310 is reduced, the intensity of the electric field in the volume between the EDM tool 300 and the workpiece 310 becomes larger than the strength of the dielectric, and the dielectric breaks down allowing some current to flow between the EDM tool and the workpiece, resulting in a spark. A collateral effect of the spark is that material is removed from both the workpiece 310 and the EDM tool 300. Once the electrical current flow stops, new liquid dielectric is flushed between the EDM tool 300 and the workpiece 310, thereby evacuating the particles that have been removed from the EDM tool 300 and the workpiece 310. Consequently the cross-section of the EDM tool 300 dictates the shape of the hole which is milled out of the workpiece 310.

In FIG. 4, an EDM tool 300 is illustrated in contact with a cast workpiece 310. The EDM tool 300 can be connected to an EDM apparatus using any known EDM technique, however, it is illustrated in FIG. 4 apart from the EDM apparatus to illustrate its cross-sectional shape. The EDM tool 300 has a general "T" shaped cross section, with a generally horizontal bar portion 320, and a generally vertical post section 330.

When the EDM tool 300 is pressed into the cast vane segment (workpiece 310), the EDM tool 300 removes material from the segment in the shape of its cross section, thereby creating the featherseal slot 146 (illustrated in FIGS. 2A, 2B, and 3). Simultaneous with this action, the post portion 330 removes material from the featherseal rails 186, 182 thereby creating the lightening pocket 146 (illustrated in FIGS. 2 and 3). Since the EDM tool 300 removes the material from both the featherseal slot 146 and the lightening pocket 146 simultaneously, the incidences of flashing or burring are substantially reduced, or eliminated. Additionally, the possibility of an interrupted sealing surface is reduced, as there is no chance for the lightening pocket portion to be misaligned.

The general cross sectional shape of the EDM tool 300 is defined by the combined shape of the featherseal slot 146 and the lightening pocket 148. The EDM tool 300 can have a portion 332 which extends beyond the lightening pocket in the opposite direction as the featherseal slot, as there is no material in the cast component (the workpiece 310) in that location. Furthermore, the cross portion 320 can be convexly curved as is illustrated, truly horizontal, concavely curved or be any desired combination of the above depending on the requirements of the featherseal slot 146.

Figure 5:
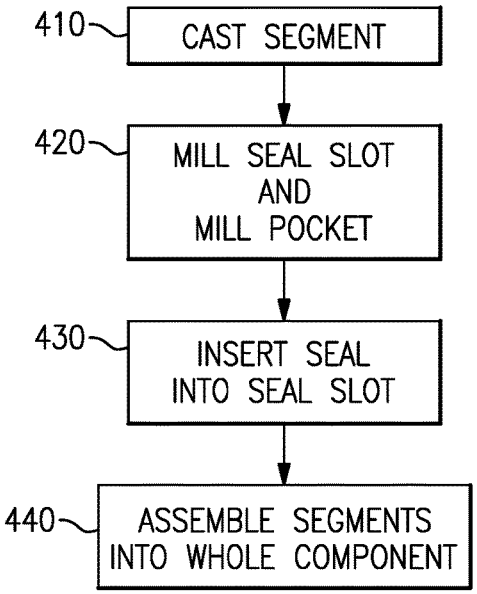
FIG. 5 illustrates a flowchart of an example of the disclosed manufacturing method.

FIG. 5 illustrates a flow chart, exemplifying a process for creating a segmented engine component having a cooling passageway and featherseals using the above description. In the first step (the cast segment step 410), each of the segments, which will be assembled into the component, are cast using known casting techniques. Once the segments have been cast, the process moves on to the mill step 420. In the mill step 420, a featherseal slot and a lightening pocket are simultaneously milled into the cast segment using the above described EDM technique. During the mill step 420, this process is performed on each of the segments. Once all of the segments have been milled, a seal is inserted into the featherseal slots in the insert seal step 430. Each of the cast components has a seal slot on each of the sides that will be joined to another segment. Each pair of adjoining sides only needs a single seal between them, thus only half of the seal slots have a seal inserted into them in this step. Finally, the segments are assembled into a whole component in the assembled component step 440. In this step, each of the components are joined together with each featherseal sealing a joint between two segments. In this way, the full component is created and assembled and is ready for installation in a gas turbine engine.

While the above descriptions are given with regards to a segmented turbine vane assembly, the process may be used for any segmented component using featherseals.

Although an example has been disclosed, a worker of ordinary skill in this art would recognize that certain modifications would come within the scope of this invention. For that reason, the following claims should be studied to determine the true scope and content of this invention.

What is claimed is:

1. A method for creating a segmented engine component comprising the steps of, casting a plurality of segments for said segmented component, wherein each of said segments comprises a body having at least a first joint end capable of connecting to a first joint end of an adjacent segment, and at least a portion of said body has a foil shaped profile, and simultaneously milling at least a featherseal slot and a pocket into at least one circumferential edge of said joint end of each of said plurality of segments.

2. The method of claim 1, wherein said step of simultaneously milling at least a featherseal slot and a pocket into each of said plurality of segments further comprises using an Electrical Discharge Machining (EDM) process to perform said milling.

3. The method of claim 2, wherein said step of simultaneously milling at least a featherseal slot and a pocket into each of said plurality of segments further comprises removing flashing resulting from said step of casting a plurality of segments.

4. The method of claim 2, wherein said EDM process utilizes an EDM tool having a generally T-shaped cross section with a cross bar portion for milling a featherseal slot, and a post portion for milling a pocket.

5. The method of claim 4, wherein said cross bar portion has a component which is convex relative to said post portion.

6. The method of claim 4, wherein said cross bar portion comprises a component perpendicular to said post portion in a cross-sectional plane.

7. The method of claim 4, wherein said cross bar portion and said post portion are a single piece of material.

8. The method of claim 4, wherein said post portion is at least substantially rectangular and comprises a component perpendicular to said cross bar in a cross sectional plane.

9. The method of claim 1, wherein said pocket is a lightening pocket.

10. The method of claim 1, further comprising the additional step of assembling said segmented component such that each of said joint ends is connected to at least one adjacent joint end and said connection is sealed using a featherseal arrangement.

11. The method of claim 1, wherein said step of simultaneously milling at least a featherseal slot and a pocket into at least one circumferential edge of said joint end of each of said plurality of segments comprises milling said featherseal slot and said lightning pocket to a uniform depth into said segment.

12. A gas turbine engine component comprising, a plurality of segments, wherein each of said segments comprises a body, at least a first joint end, and at least one featherseal slot and pocket in a circumferential edge of said first joint end;

wherein said featherseal slot and said pocket comprise a single gap in said component, wherein said single gap has a uniform depth into said segment, and each of said segments being connected to at least one adjacent segment such that a sealed cooling passage connects each of said segment's cooling inlets.

13. The gas turbine engine component of claim 12, wherein said single gap has a generally T-shaped cross section.

14. The gas turbine engine component of claim 13, wherein said generally T-shaped cross section comprises a cross bar portion and a post portion, and wherein said post portion of said cross section extends from said cross bar portion away from said segment body.

15. The gas turbine engine component of claim 12, wherein each of said segments is connected to at least one adjacent segment via a featherseal arrangement.

16. The gas turbine engine component of claim 15, wherein said featherseal arrangement comprises a sheet of material partially inserted in a featherseal slot on a first of said plurality of segments, and partially inserted in a featherseal slot on a second of said plurality of segments, and wherein said first and second of said plurality of segments are immediately adjacent to each other.

17. The gas turbine engine component of claim 12, wherein the assembled gas turbine engine component is a turbine vane assembly.

18. The gas turbine engine component of claim 17, wherein each of said plurality of segment's bodies comprises a foil shaped profile.

19. The gas turbine engine component of claim 12, wherein said single gap in said component is filled in while said component is cast, and is removed via an Electrical Discharge Machining process.

20. The gas turbine engine component of claim 12, wherein said single gap in said component comprises substantially no flashing.

* * * * *